US009617737B2

(12) United States Patent
Benini

(10) Patent No.: US 9,617,737 B2
(45) Date of Patent: Apr. 11, 2017

(54) WATERPROOF DECORATIVE SHEATH SYSTEM FOR WALLS OF MOIST ENVIRONMENTS, AND METHOD FOR MAKING IT

(71) Applicant: WALL&DECÓ S.R.L., Cervia (Ravenna) (IT)

(72) Inventor: Christian Benini, Cervia (IT)

(73) Assignee: WED S.R.L., Cervia (Ravenna) (IT)

( * ) Notice: Subject to any disclaimer, the term of this patent is extended or adjusted under 35 U.S.C. 154(b) by 0 days.

(21) Appl. No.: 14/852,823

(22) Filed: Sep. 14, 2015

(65) Prior Publication Data

US 2016/0076255 A1 Mar. 17, 2016

(30) Foreign Application Priority Data

Sep. 15, 2014 (IT) ..... BO2014A0503

(51) Int. Cl.

| | |
|---|---|
| ***E04F 13/08*** | (2006.01) |
| ***D06N 7/00*** | (2006.01) |
| ***E04F 13/077*** | (2006.01) |
| ***E04F 13/02*** | (2006.01) |
| ***D06N 3/00*** | (2006.01) |

(Continued)

(52) U.S. Cl.

CPC ..... *E04F 13/08* (2013.01); *D06N 3/0022* (2013.01); *D06N 3/14* (2013.01); *D06N 7/0002* (2013.01); *E04F 13/02* (2013.01); *E04F 13/077* (2013.01); *E04B 1/66* (2013.01)

(58) Field of Classification Search

CPC ..... E04F 13/08; E04F 13/02; E04F 13/002; E04F 13/077; D06N 7/0002; D06N 2209/128; D03D 15/0011

See application file for complete search history.

(56) References Cited

U.S. PATENT DOCUMENTS 2,812,277 A * 11/1957 Hemming ..... D06N 3/0065 156/209
4,278,728 A * 7/1981 Honda ..... B05D 7/546 156/79

(Continued)

FOREIGN PATENT DOCUMENTS

EP 2551318 A2 * 1/2013 ..... C08K 3/22
GB 2509821 A * 7/2014 ..... C04B 26/16

*Primary Examiner* — Brent W Herring

(74) *Attorney, Agent, or Firm* — Tutunjian & Bitetto, P.C.

(57) ABSTRACT

A waterproof decorative sheath system for walls of moist environments, including at least one layer of waterproofing material applicable on the wall surface of the moist environment, a first layer of specific adhesive material applied on the layer of waterproofing material, a layer of glass fiber tissue, applied on the first layer of specific adhesive material, having the final decorative aspect to be given to the walls, a second layer of specific adhesive material applied on the layer of glass fiber tissue, a substantially transparent first protective finishing layer, applied on the second layer of specific adhesive material, suitable for giving the layer of glass fiber tissue a partly translucent aspect, and a second substantially transparent scratch-resistant protective finishing layer, applied on the first protective finishing layer, to obtain a finished system that does not require the application of further additional decorative elements to obtain the desired final aspect.

11 Claims, 1 Drawing Sheet

(51) Int. Cl.
*D06N 3/14* (2006.01)
*E04B 1/66* (2006.01)

(56) References Cited

U.S. PATENT DOCUMENTS 4,604,312 A * 8/1986 Creighton ..... D06N 7/0007 156/252
4,788,091 A * 11/1988 Rossitto ..... C08G 18/10 427/208.2
5,336,354 A * 8/1994 Looi ..... B29C 70/08 156/277
5,672,229 A * 9/1997 Konig ..... C08G 18/302 156/331.4
5,853,835 A * 12/1998 Leniton ..... B32B 17/10247 428/38
5,942,330 A * 8/1999 Kelley ..... B32B 27/08 428/343
6,627,022 B2 * 9/2003 Fusco ..... B29C 70/50 156/155
6,883,286 B2 * 4/2005 Wright, Jr. ..... B44C 1/105 52/105
7,216,461 B1 * 5/2007 Clemmer ..... A47B 77/022 52/177
7,263,811 B1 * 9/2007 Clemmer ..... A47B 77/022 156/298
8,071,218 B2 * 12/2011 Kapkin ..... B44C 5/0407 156/100
8,316,604 B2 * 11/2012 Thiers ..... B44C 1/24 428/172
8,563,100 B1 * 10/2013 Zhou ..... B41M 5/5218 428/32.16
8,925,275 B2 * 1/2015 Meersseman ..... B27N 7/00 52/313
2001/0046587 A1 * 11/2001 Michael ..... B32B 3/266 428/137
2002/0014047 A1 * 2/2002 Thiers ..... B44C 1/24 52/313
2002/0106952 A1 * 8/2002 Hashizume ..... B29C 45/14221 442/43
2005/0016096 A1 * 1/2005 Wright ..... B44C 1/105 52/311.1
2005/0233656 A1 * 10/2005 Royer ..... D02G 3/447 442/2
2010/0071277 A1 * 3/2010 Schacht ..... B44C 5/04 52/173.1
2010/0151759 A1 * 6/2010 Capwell ..... D06M 11/44 442/71
2010/0300020 A1 * 12/2010 Vermeulen ..... B44C 5/0484 52/177
2011/0281484 A1 * 11/2011 Yoshida ..... C03C 13/00 442/180
2012/0276348 A1 * 11/2012 Clausi ..... B32B 29/002 428/196
2013/0101744 A1 * 4/2013 Yano ..... C04B 41/009 427/407.2
2013/0104485 A1 * 5/2013 Meersseman ..... B27N 7/00 52/578
2015/0107178 A1 * 4/2015 Meersseman ..... B27N 7/00 52/313
2015/0121793 A1 * 5/2015 Segaert ..... B29C 70/081 52/506.01

* cited by examiner

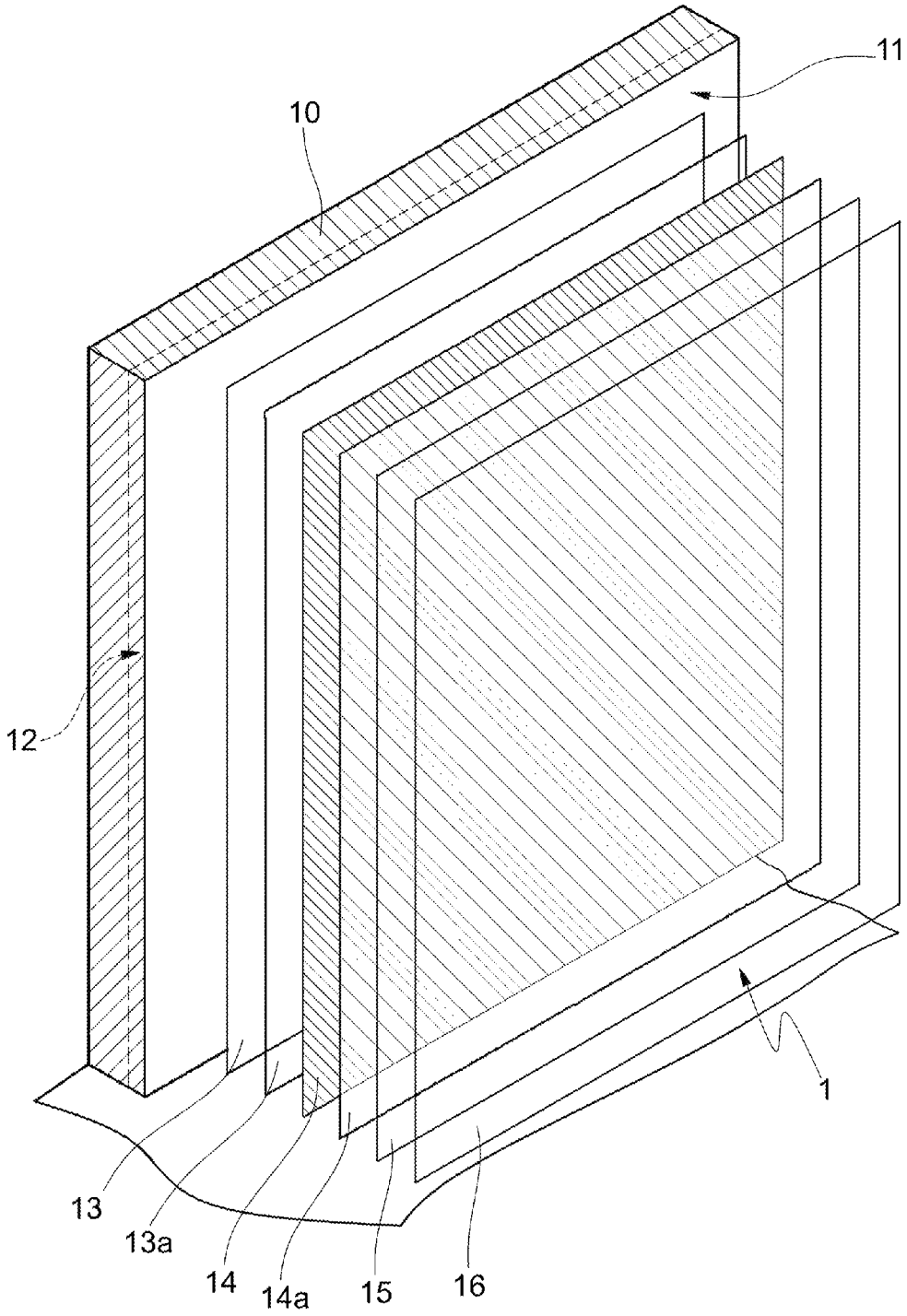
11
10
12
1
13
13a
14
14a
15
16

WATERPROOF DECORATIVE SHEATH SYSTEM FOR WALLS OF MOIST ENVIRONMENTS, AND METHOD FOR MAKING IT

CROSS REFERENCE TO RELATED APPLICATIONS

This application claims the benefit of priority from Italian Patent Application No. BO2014A000503 filed on Sep. 15, 2014, the contents of which are incorporated herein by reference.

TECHNICAL FIELD OF THE INVENTION

The present invention concerns a waterproof decorative sheath system for walls of moist environments.

The present invention also concerns a method for making such a waterproof decorative sheath system.

In greater detail, the present invention concerns a waterproof decorative sheath system for walls of moist environments, as well as the method for making it, of the type consisting of a kit of components to be assembled on site suitable for generating a finished product that does not need the application of further additional decorative elements, such as ceramic tiles and the like, to give the wall the desired final aspect.

STATE OF THE ART

Currently, the waterproofing of indoor moist environments, for example at the walls and/or floors of bathrooms, laundry rooms or other similar environments, is usually obtained by applying, under the normal coating of ceramic tiles, products such as cementitious elastic sheaths or similar, which prevent water from penetrating into the underlying areas.

The aforementioned products are applied when they are in liquid state; normally after a few hours from application they dry out and allow the subsequent gluing of the tiles or of other similar coating elements.

In addition, or as an alternative, to the aforementioned products it is also possible to use bands of polymeric materials (PVC, TPE or others), ad for example for the specific waterproofing of corners, expansion joins and crossing of pipes or drains.

The products and the methods of application described above can be effective and advantageous when dealing with a new building or in the complete renovation of the room, i.e. in the typical cases in which the coating of ceramic tiles is not present or must be completely removed and then applied again.

However, there are particular situations in which it may be required to completely waterproof an indoor environment—typically a bathroom, a shower cubicle, a laundry room, or similar—without having to remove the existing coatings, for structural, economic, aesthetic or other kinds of reasons.

Of course, such a requirement must be satisfied while fully respecting the specific aspect that it is wished to give to the environment: in other words, waterproofing must take place while also ensuring a completely satisfactory final aesthetic result.

Waterproofing solutions currently on the market also have problems relative to the compatibility of the different components used in the application process, since the latter have different chemical-physical characteristics. The problems of compatibility of the various components compromise the performance and seal over time of the waterproofing solution.

The decorative element comes later, i.e. it does not constitute an integral part of existing waterproofing systems. Waterproof sheaths currently available are not finished decorative products. Moreover, the latest generation of coatings have properties of mechanical resistance to peeling or resistance to water, but they do not have the technical characteristics of waterproof decorative sheaths.

SUMMARY OF THE INVENTION

The technical task of the present invention is to improve the state of the art, improving existing products.

In such a technical task, a purpose of the present invention is to provide a waterproof decorative sheath system for walls of moist indoor environments that can be applied even on pre-existing coatings, without having to carry out any removal intervention of possible materials already present on the walls to be treated.

Yet another purpose of the present invention is to make a waterproof decorative sheath system that incorporates any desired aesthetic result on walls of moist indoor rooms.

Another purpose of the present invention is to provide a waterproof decorative sheath system for walls of moist environments suitable for constituting a finished product, in particular in the form of a complete kit able to be installed on site, suitable for achieving both the optimal waterproofing of the wall involved and the desired final aesthetic aspect, without any limitation in a single sequential process.

A further purpose of the present invention is to provide a method for making a waterproof decorative sheath system that is extremely simple, quick and cost-effective to apply, given that it combines, in the same product and application process, both the function of a waterproof sheath and of decoration of the wall.

This task and these purposes are all accomplished by the waterproof decorative sheath system according to the present principles.

The waterproof decorative sheath system for walls of moist environments according to the invention comprises a layer of waterproofing material applied on the surface of the wall involved, a first layer of specific adhesive material applied on the layer of waterproofing material, a layer of decorated glass fibre tissue applied on the first layer of specific adhesive material, already having the final aspect to be given to the walls; a second layer of specific adhesive material applied on the layer of decorated glass fibre tissue having the final aspect to be given to the walls. Thereafter, the system comprises a first transparent protective finishing layer applied, in two successive coats, on the second layer of specific adhesive material, made from a material suitable for giving the layer of glass fibre tissue itself a partly translucent aspect. Completing the waterproof decorative sheath system is at least one second transparent protective finishing layer, made with properties of scratch-resistance and resistance to the main detergents used for cleaning domestic moist environments, applied on the second coat of the first protective finishing layer.

Such a task and such purposes are also achieved by a method for making a waterproof decorative sheath system for walls of moist indoor environments according to the present principles.

The dependent claims refer to preferred and advantageous embodiments of the invention.

BRIEF DESCRIPTION OF THE DRAWINGS

The characteristics of the invention will become clearer to those skilled in the art from the following description and from the attached table of drawings, given as a non-limiting example, in which:

FIG. 1 is an axonometric schematic and exploded view of a wall of an indoor environment with an associated waterproof decorative sheath system according to the present invention.

DETAILED DESCRIPTION OF THE INVENTION

With reference to the attached FIG. 1, a waterproof decorative sheath system according to the present invention is wholly indicated with 1.

In particular, FIG. 1 schematically illustrates a wall 10 of an indoor room with an associated waterproof decorative sheath system 1 according to the invention, the latter represented in an exploded view to make it easier to understand.

The indoor room comprising the wall 10 can consist, for example, of a bathroom, a laundry room, a shower cubicle, a room of a health centre, or other, without any limitation to the purposes of the present invention.

More generally, it concerns a moist environment in which the walls are frequently exposed to water.

The wall 10 can be vertical or inclined, without distinction.

In greater detail, the wall 10 comprises a respective surface 11 on which the waterproof decorative sheath system 1 according to the present invention is intended to be applied.

The surface 11 on which the system 1 can be applied can be of any kind.

For example, the surface 11 can consist of cement rendering or plasterboard for moist environments.

Alternatively, the surface 11 can comprise a pre-existing coating 12, for the sake of simplicity represented with a broken line in FIG. 1.

The coating 12 can be of any material.

For example, the coating 12 can be made from glass, PVC, sheet metal and stainless steel.

According to a very frequent situation, the coating 12 can consist of ceramic tiles, of any shape, size and surface quality.

According to an aspect of the present invention, the waterproof decorative sheath system 1 comprises a layer of waterproofing material 13.

The layer of waterproofing material 13 is applicable on the surface 11 of the wall 10.

Moreover, the system 1 according to the invention comprises a layer of specific adhesive material 13*a*.

The layer of specific adhesive material 13*a* is applicable over the layer of waterproofing material 13.

The layer of waterproofing material 13 allows the surface that it is wished to coat to be made not only resistant, but also waterproof. By its chemical formulation, it forms a chemical-physical bond with the layer of specific adhesive material 13*a* that allows the waterproof decorative sheath system 1 to grip firmly, and in a permanent manner, to the surface 11 of the wall 10.

The layer of specific adhesive material 13*a* also gives a high power of resistance of the system 1 to mould and fungi that can occur on the surfaces of moist environments, in particular in the shower cubicle.

According to another aspect of the present invention, the waterproof decorative sheath system 1 comprises at least one layer of decorated glass fibre tissue 14.

The layer of decorated glass fibre tissue 14 is applied on the layer of specific adhesive material 13*a*.

The layer of decorated glass fibre tissue 14 has the aspect that is intended to be given to the wall 10, as made clearer hereafter.

The waterproof decorative sheath system 1 according to the invention also comprises a second layer of specific adhesive material 14*a*.

The second layer of specific adhesive material 14*a* is applied on the layer of decorated glass fibre 14.

The second layer of specific adhesive material 14*a* is in particular diluted with 20% water, which allows the waterproofing power of the sheath system 1 to be strengthened.

According to a further aspect of the present invention, the waterproof decorative sheath system 1 comprises two transparent or substantially transparent protective finishing layers 15,16.

The first protective finishing layer 15 is applied on the second layer of specific adhesive material 14*a*.

The first protective finishing layer 15 is suitable for giving the aforementioned layer of decorated glass fibre tissue 14 beneath a partly translucent aspect, as made clearer hereafter, and of first protection of the waterproof decorative sheath system 1 from external agents (minerals, chemical agents).

The first protective finishing layer 15 is preferably applied in two coats.

The first protective finishing layer 15 also performs the function of protection of the pigments of the inks used to print the decoration on the layer of decorated glass fibre tissue 14. This protective action is carried out also against the second protective finishing layer 16 according to the following paragraph. The latter, indeed, due to its specific chemical formulation, can alter the colour of the decoration of the waterproof decorative sheath system 1 if the first protective finishing layer 15 were not present.

As stated, according to another aspect of the present invention, the waterproof decorative sheath system 1 comprises a second transparent or substantially transparent protective finishing layer 16.

The second protective finishing layer 16 is applied on the second coat of the first protective finishing layer 15.

In particular, the second protective finishing layer is of the type resistant to scratching, bangs and abrasion.

In this way, the outer surface of the system 1 is preserved from bangs or scratches that could damage its integrity.

The second protective finishing layer 16 gives the system 1 its special suitability for being used directly in the shower cubicle because as well as being waterproof, thanks to the presence of the second protective finishing layer 16 the system 1 can be cleaned with the detergents commonly used for cleaning moist environments (including anti-limescale products, or the use of a scouring pad for removing the most persistent dirt).

In greater detail, the adhesive material with which the first layer 13*a* and the second layer 14*a* are made is of the single-component type in aqueous dispersion.

It comprises a thixotropic paste easily applied by roller, with initial wet adhesivity such as to keep successive layers even of substantial weight firmly in position.

Only as an example, it should be specified that it is a white-coloured product, with density of 1.05 kg/dm$^3$ and setting time of 6-8 hours (final setting time 24-48 hours).

The product has high resistance to ageing, to water and to yellowing, and heat resistance up to about 80° C. It is used in amounts of about 200-250 g/m$^2$.

The combined action of the layer of waterproofing material 13 and of the layers of specific adhesive material 13*a*,14*a* applied under and over the layer of glass fibre tissue 14 encapsulates the materials within a single substrate thanks to the specific formulation of the chemical components of such material, which combine high properties of waterproofing and of anchoring of the substrate to the surface.

The layer of glass fibre tissue 14 comprises printed patterns and/or other decorative elements.

Indeed, as stated, the layer of glass fibre tissue 14 has the aspect that it is wished to give to the wall 10 on which the waterproofing system 1 is applied.

In other words, the layer of glass fibre tissue 14, being coated with a first and a second transparent or substantially transparent protective finishing layer 15, 16, with the system 1 completely applied, is directly visible from the outside, and therefore it must have the aesthetic characteristics that are wished to be obtained on the wall 10.

The layer of glass fibre tissue 14 maintains substantially the physical and chemical characteristics of glass, and offers substantial mechanical resistance to bangs, peeling, settling cracking and fissures.

Such characteristics also make it possible to consolidate the masonry support of the wall 10.

The tissue is also atoxic, fireproof and easy to wash.

Thanks to the low electrostatic charge of glass, it avoids the accumulation of dust.

The layer of glass fibre tissue 14 comprises a number of threads comprised between 70/dm and 90/dm for the warp and comprised between 40/dm and 60/dm for the weft.

Moreover, the layer of glass fibre tissue 14 has a weight of about 275 g/m$^2$.

The first protective finishing layer 15 comprises a polymeric material of the bi-component aliphatic polyurethane-water type, i.e. in aqueous dispersion.

The first protective finishing layer 15 is applied in liquid phase through a roller, preferably short-haired.

The first protective finishing layer 15 is applied, as stated, in two coats, applied about 6-8 hours at most after one another.

The complete drying time of the two coats is about 24 hours.

The material with which the first protective finishing layer 15 is made is preferably used in amounts of about 35-45 g/m$^2$.

The first protective finishing layer 15 has an adhesion >4 on concrete (pull-off test)*, ASTM D 4541. It also has a resistance to abrasion (film in 2 coats, total dry thickness: 200 mm), of 92±5 mg.

As stated, the first protective finishing layer 15 gives the waterproof decorative sheath system a semi-translucent, or semi-gloss effect.

The first protective finishing layer 15 also has high flexibility and is particularly resistant to yellowing. The second protective finishing layer 16 comprises a polymeric material of the monocomponent, moisture curing aliphatic polyurethane type, without solvents.

The drying times of the second protective finishing layer 16 thus depend on the climatic and humidity conditions: during application the relative humidity of the air must be comprised between 40 and 50% UR and the temperature must not be less than 10° C.

Complete drying is usually achieved after 48-72 hours. After this time has passed, the treated environments are perfectly usable.

As well as the aforementioned high scratch resistance, the second protective finishing layer 16 is very resistant to yellowing.

Moreover, the second protective finishing layer 16 gives the application surface a finish that adheres well to the support and has properties of substantial opacity.

The material with which the second protective finishing layer 16 is made is preferably used in amounts of about 100-110 g/m$^2$.

The system 1 consisting of the union of the aforementioned components makes it possible to obtain an optimal resistance to the penetration of humidity through the wall 10, together with the possibility of making a final outer surface having the desired aspect.

Indeed, the layer of decorated glass fibre tissue 14, as well as having optimal mechanical characteristics for application on any type of surface—for example strength, elasticity and lightness—can be made with any printed pattern, design, decorative element or other, of any colour or combination of colours, without any limitation.

The application of the successive transparent or substantially transparent protective finishing layers 15, 16 does not prevent the layer of glass fibre tissue 14 beneath from being seen; rather, the optical properties of the aforementioned finishing layers 15, 16 make it possible to enhance and highlight, if so desired, the aesthetic characteristics of the layer of glass fibre tissue 14.

The application of the waterproof decorative sheath system 1, according to the present invention, combines the function of decoration and waterproofing in a single system that is simple, cost-effective and quick to apply on any type of existing surface 11.

As stated, it is not necessary to remove any pre-existing coating 12 to obtain an optimal application of the system 1 according to the invention.

It is underlined that with waterproofing we mean the feature according to which the system 1 is totally impenetrable by water when exposed thereto.

For example, the impermeability test is, or can be, carried out in accordance with the standard EN 1928, method A or B.

More generally, all of the technical characteristics of the system 1 according to the invention can be evaluated or tested in relation to what is prescribed in the "Guideline for European Technical approval" ETAG 022 relative to "Watertight covering kits for wet room floors and or walls".

It should also be noted that, in other embodiments of the invention, the layer of decorated glass fibre tissue could be replaced by a layer of different material having a decorative function or on which decorative patterns are in any case displayed.

Another object of the present invention is the method for making a waterproof decorative sheath system 1 for walls 10 of moist environments having the characteristics previously described.

The method according to the invention makes it possible to obtain a finished product having the desired technical and aesthetic characteristics that, once completely applied, does not require the application of further additional decorative elements such as tiles and the like.

The method can comprise a preliminary step of preparation of the surface 11 of the specific wall 10 on which the simultaneously waterproof and decorative system 1 of a wall surface must be made in a moist environment. Such a preparation step—which is in any case optional—is specific for the type of surface 11 on which the system 1 must be applied.

In general, the surface 11 to be waterproofed and decorated must be substantially dry, clean and free from irregularity.

If necessary, therefore, it can be partially or completely consolidated or reconstructed with specific products.

In relation to the chromatic tone of the surface 11 and to that of the layer of glass fibre tissue 14 that will be applied, it may be necessary to apply a coat of white washable water-based paint, to cover the possible dark tone of the original surface 11.

The method—after such a preparation step—foresees a step of applying at least one layer of waterproofing material 13, and a first layer of specific adhesive material 13*a* on the surface 11 of the wall 10 involved.

The application of the layer of waterproofing material 13 must be applied with a spatula at temperatures comprised between 5°-35° C. whereas the application of the first layer of specific adhesive material 13*a* can easily be carried out with a roller, at temperatures not below 8° C.

Thereafter a step of application of at least one layer of decorated glass fibre tissue 14 is foreseen, having the final aspect to be given to the specific wall 10, on the first layer of specific adhesive material 13*a*. The application of the layer of glass fibre tissue 14 can be carried out through a roller.

Once the correct position has been reached, the layer of glass fibre tissue 14 must be pressed with a plastic spatula from the centre towards the edges, to expel air bubbles and to ensure optimal adherence.

Since glass fibre tissue 14 is supplied in sheets of predetermined dimensions, on the same surface 11 such sheets must be applied so as to ensure, of course, the continuity of the decorative pattern displayed on them.

Once the layer of glass fibre tissue 14 has been correctly and perfectly fixed on the first layer of adhesive material 13*a*, the method according to the invention comprises a subsequent step of applying a second diluted layer of specific adhesive material 14*a* and, once the drying times have passed, two transparent or substantially transparent protective finishing layers 15,16 on the second layer of specific adhesive material 14*a*.

The first protective finishing layer 15 is suitable for giving the layer of glass fibre tissue 14 a partly translucent, or semi-gloss aspect.

The material with which the first protective finishing layer 15 is made is, as stated, bi-component polymeric.

The two components are previously mixed and diluted with water in a maximum amount equal to 20%, possibly using a professional mechanical mixer.

The first protective finishing layer 15 can be applied through a short-haired roller.

The application must be carried out in two successive coats separated in time by 6-8 hours at most.

The application must take place at a temperature comprised between 10° C. and 30° C.

For about 6-8 hours after application the first protective finishing layer 15 must be protected from contact with water.

The complete drying time of the first protective finishing layer 15 is about 24 hours.

After the complete drying of the first protective finishing layer 15, the method according to the invention foresees a further step of applying, on the first protective finishing layer 15 itself, a second protective finishing layer 16, which is transparent or substantially transparent, and scratch resistant.

The scratch resistance of the second protective finishing layer 16 is to be understood, and/or can be evaluated, in relation to what is foreseen by the aforementioned document ETAG 022.

The environment is usable after about 36-48 hours from application. The application of this further second protective finishing layer 16 makes it possible to give the system 1 thus obtained the necessary surface mechanical resistance against external agents potentially capable of damaging the layer of glass fibre tissue 14 below. It has thus been seen how the invention achieves the proposed purposes.

The proposed solution makes it possible to obtain, in a single system, the technical properties and the effective waterproofing together with the decorative function of walls of moist environments. Indeed, the waterproof decorative sheath system proposed does not need further applications of coatings of the desired aesthetic characteristics, since it is actually made so as to already have the final aspect that it is wished to give to the wall.

In other words, advantageously it is a finished product—i.e., a kit or system completely assembled on site—which makes it possible to make a wall 10 of a moist environment totally waterproof, at the same time giving it the desired final aesthetic aspect, unlike what occurs for all other waterproofing systems present on the market that, on the other hand, necessarily require the application of successive decorative elements, which do not constitute part of the system—for example tiles—to give the wall the desired aspect.

Indeed, as stated, the waterproofing sheaths currently on the market are not suitable for being applied directly in view on the surfaces involved, since the final appearance that they assume after drying is not suitable as well as not usually being appealing or modifiable or personalisable in any way apart from by using further additional components.

By using known waterproofing sheaths it is thus obligatory to apply onto the surface of the sheath itself, and at a later time, further additional elements, such as tiles or similar, thus lengthening the completion times of the work and obviously increasing the costs thereof.

The waterproof decorative sheath system can be applied without removing the coating already present, or any other structural element already permanently applied. The proposed solution is applicable in short time periods, does not require either skill or special equipment and is extremely cost-effective.

All of the components of the system 1 according to the invention have been specifically and synergically designed so as to obtain an end result suitable for providing the desired performance, as well as long-lasting and reliable over time.

In greater detail, each component has been specially designed and optimised in the chemical formulation and in the method of application for the specific application according to the present invention: in other words, none of such components is already on the market with the characteristics required in the present application.

The present invention has been described according to preferred embodiments, but equivalent variants can be devised without departing from the scope of protection offered by the following claims.

The invention claimed is:

1. A waterproof decorative sheath system for walls of moist environments, so as to obtain a predetermined/desired final decorative aspect for walls, comprising:

at least one layer of waterproofing material applicable on the surface of a wall of the moist environment;

a first layer of adhesive material applied on said layer of waterproofing material;

a layer of decorated glass fibre tissue comprising threads of warp and weft, and comprising printed patterns and/or other decorative elements, applied on said first layer of adhesive material, so as to obtain the final decorative aspect to be given to the wall;

a second layer of a diluted adhesive material, applied on said layer of glass fibre tissue;

a first transparent or substantially transparent protective finishing layer, applied in two coats on said second layer of adhesive material, made of a material suitable to give said layer of glass fibre tissue a partly translucent aspect; and a transparent second protective finishing layer made of a material with scratch-resistance properties, applied on said first protective finishing layer, so as to obtain a finished system that does not require the application of further additional decorative elements to obtain the desired final aspect, wherein said layer of waterproofing material and said first layer of adhesive material applied under said layer of glass fibre tissue and said second layer of adhesive material applied over said layer of glass fibre tissue, encapsulate the glass fibre tissue to form a single substrate.

2. The system according to claim 1, wherein said adhesive material is of the single component type in aqueous dispersion.

3. The system according to claim 2, wherein said adhesive material comprises a thixotropic paste.

4. The system according to claim 1, wherein the material of which said first protective finishing layer is made comprises a polymeric material of the water-based bi-component aliphatic polyurethane type.

5. The system according to claim 1, wherein the material of which said second protective finishing layer is made comprises a polymeric material of the solvent-free single component aliphatic polyurethane type.

6. The system according to claim 1, wherein said layer of glass fibre tissue comprises a number of threads ranging from 70/dm to 90/dm for the warp and ranging from 40/dm to 60/dm for the weft.

7. The system of claim 1, wherein the layer of decorated glass fibre tissue is elastic.

8. A method for obtaining a decorative waterproof sheath system of walls of moist environments, so as to obtain a predetermined/desired final decorative aspect for walls, comprising the steps of:

applying on the surface of a wall of the moist environment at least one layer of a waterproofing material;

applying at least one first layer of adhesive material on said layer of waterproofing material;

applying a layer of decorated glass fibre tissue comprising threads of warp and weft, and comprising printed patterns and/or other decorative elements so as to obtain the final aspect to be given to the walls on said first layer of adhesive material;

applying a second diluted layer of adhesive material over said layer of glass fibre tissue;

applying, in two coats, a first transparent or substantially transparent protective finishing layer, on said second layer of adhesive material, said first protective finishing layer being made of a material suitable to give said layer of glass fibre tissue a partly translucent aspect; and applying at least one transparent or substantially transparent second protective finishing layer made of a scratch-resistant material, on said first protective finishing layer, so as to obtain a finished system that does not require the application of further additional decorative elements to obtain the final desired aspect, wherein said layer of waterproofing material and said first layer of adhesive material applied under said layer of glass fibre tissue and said second layer of adhesive material applied over said layer of glass fibre tissue, encapsulate the glass fibre tissue to form a single substrate.

9. A method according to claim 8, wherein said step of applying at least one first protective finishing layer is carried out using a roller in two successive coats separated from one another by a time period of about 6-8 hours.

10. The method according to claim 8, wherein said step of applying at least one second protective finishing layer is carried out using a roller in a single coat.

11. The method according to claim 8, comprising a step of preparing the surface of a wall of the moist environment in order to be substantially dry, clean and free from irregularity.

* * * * *